US007537501B2

(12) United States Patent
Godoy

(10) Patent No.: US 7,537,501 B2
(45) Date of Patent: May 26, 2009

(54) SWIMMING FIN WITH HEEL STRAP FASTENING BUCKLE

(75) Inventor: Carlos Godoy, Genoa (IT)

(73) Assignee: Cressi-Sub S.p.A., Genova (IT)

( * ) Notice: Subject to any disclaimer, the term of this patent is extended or adjusted under 35 U.S.C. 154(b) by 0 days.

(21) Appl. No.: 11/541,277

(22) Filed: Sep. 30, 2006

(65) Prior Publication Data

US 2007/0077832 A1 Apr. 5, 2007

(30) Foreign Application Priority Data

Sep. 30, 2005 (IT) ..... FI2005A0205

(51) Int. Cl.
*A63B 31/08* (2006.01)
*A63B 31/11* (2006.01)

(52) U.S. Cl. ..... 441/64; 441/61; 441/62; 441/63

(58) Field of Classification Search ..... 441/61–64
See application file for complete search history.

(56) References Cited

U.S. PATENT DOCUMENTS

| | | | | |
|---|---|---|---|---|
| 4,251,894 | A | 2/1981 | Hollingsworth | 9/309 |
| 4,670,946 | A | 6/1987 | Olivieri | 24/71 SK |
| 4,795,384 | A * | 1/1989 | Hattori | 441/64 |
| 4,887,985 | A | 12/1989 | Garofalo | 441/64 |
| 5,304,081 | A | 4/1994 | Takizawa | 441/64 |
| D350,801 | S | 9/1994 | Dagnino | D21/239 |
| 5,358,439 | A | 10/1994 | Paolo | 441/64 |
| 5,443,593 | A | 8/1995 | Garofalo | 441/64 |
| 5,467,508 | A | 11/1995 | Feng | 24/68 SK |
| 5,542,865 | A | 8/1996 | Alvarez De Toledo | 441/64 |
| 5,545,067 | A * | 8/1996 | Garofalo | 441/64 |
| 5,588,890 | A | 12/1996 | Garofalo | 441/64 |
| 5,607,334 | A | 3/1997 | Garofalo | 441/64 |

(Continued)

FOREIGN PATENT DOCUMENTS

| | | |
|---|---|---|
| DE | 2712737 | 9/1978 |

(Continued)

OTHER PUBLICATIONS

Kiefer, Fall, 2002, pp. 72 and 73, swimming fins, www.kiefer.com.

*Primary Examiner*—Lars A Olson
*Assistant Examiner*—Daniel V Venne
(74) *Attorney, Agent, or Firm*—Pollack, P.C.

(57) ABSTRACT

A swimming fin comprising a blade extending from a shoe open at its rear side, and a rear heel strap connected to the sides of the shoe by at least one buckle, the buckle having a base plate integral with the shoe. A buckle arm is joined with connected to the strap so as to allow adjustment of the strap's tension, an intermediate lever being connected pivotally to the base plate and the arm. A reversible attachment member is also provided for connecting the intermediate lever to the base plate to achieve closure of the buckle. Between the intermediate lever and the base plate, a disengageable articulation member is provided for reciprocal engagement between them, a pivotal connection, and, at the same time, for allowing their separation in a direction opposite that of tensioning the strap. In this manner, the intermediate lever may be separated from the base plate following release of the attachment member, and disconnection of the disengageable articulation member.

11 Claims, 4 Drawing Sheets

U.S. PATENT DOCUMENTS

| | | | | |
|---|---|---|---|---|
| D382,322 | S | 8/1997 | Cressi | D21/239 |
| D421,474 | S | 3/2000 | Godoy | D21/806 |
| 6,224,443 | B1 | 5/2001 | Mehrmann et al. | 441/64 |
| 6,364,728 | B1 | 4/2002 | Viale et al. | 441/64 |
| 6,398,604 | B1 | 6/2002 | Kawashima et al. | 441/64 |
| 6,568,973 | B2 | 5/2003 | Testa | 441/64 |
| 6,568,974 | B2 | 5/2003 | Semeia | 441/64 |
| 6,640,396 | B1 | 11/2003 | Lin | 24/68 SK |
| D490,136 | S | 5/2004 | Godoy | D21/806 |
| 2005/0246868 | A1 | 11/2005 | Garofalo et al. | 24/170 |

FOREIGN PATENT DOCUMENTS

| | | | |
|---|---|---|---|
| EP | 0070272 | A1 | 1/1983 |
| EP | 0070272 | B1 | 12/1984 |
| EP | 0308998 | | 3/1989 |
| EP | 0484846 | A2 | 5/1992 |
| EP | 0607568 | | 7/1994 |
| EP | 0687484 | A1 | 12/1995 |
| EP | 0985431 | | 3/2000 |
| EP | 0998962 | | 5/2000 |
| EP | 1192974 | A2 | 4/2002 |
| EP | 1192974 | A3 | 5/2002 |
| FR | 1426740 | | 1/1968 |
| GB | 2148438 | A | 5/1985 |

* cited by examiner

SWIMMING FIN WITH HEEL STRAP FASTENING BUCKLE

FIELD OF THE INVENTION

The present invention relates generally to articles for self-propulsion and, more particularly, to foot mounted articles for effecting movement through fluid media or the like.

BACKGROUND OF THE INVENTION

Conventional buckles for swimming fins include, for example, two parts: a first part connected to a side of the shoe and a second part joined to a strap, the first and second parts being in snap engagement with one another. While useful, buckles of this type have been found disadvantageous in that they must necessarily be loosened to enable the fin to be put on the user's foot, and require adjustment of strap tension each time the fin is put on.

Accordingly, a buckle for swimming fins was developed that could be opened without separating the buckle into two separate parts. Specifically, both a portion of the buckle that is integral with a side of the shoe and a portion attached to an end of the strap are articulated to one another through a connection lever. This lever allows the portion connected to the strap to be moved from a position of engagement with the portion of the buckle connected to the side of the shoe (where the strap tightens the foot of the user at the rear) to a position of disengagement in which the portion to be attached to the strap is moved rearwardly relative to the fixed portion. In this manner, tension of the strap is eliminated, allowing the user to put the fin on his/her foot or remove it. Although useful, the portions that comprise the buckle are inseparable. As a result, it is not possible to separate the strap from the fin. One disadvantage of this buckle arrangement is that, in order to take the fin off, albeit with the strap loosened, the user must always remove it from his/her foot. More specifically, it is necessary that the user pass the loosened strap behind the heel with the aid of his/her hand, if necessary, which can delay operation in emergency situations.

In the buckle, the portion joined with the strap is attached by a snap connection to the portion of the buckle that is integral with the shoe, both during the opening phase and the closure phase, the snap connection being between the intermediate articulation lever and a pair of side flanges rising from the portion integral with the shoe. To open the buckle, however, the user must push the free end of the lever outwardly.

Another disadvantage of this system is that it has been found generally unsafe, in that (i) impact to the device can accidentally cause the buckle to open, and (ii) in the event that the free end of the lever becomes entangled in some external projection.

A further drawback is that, once the fin is worn on the user's foot and the buckle is closed, the tension of the strap can be increased but not decreased. More specifically, when the fin is on, the length of the strap provides relatively tight adherence to the user's foot and has a free end that may be grasped by the user and pulled to increase the tension of the strap. In order to decrease strap tension, however, the user must necessarily insert a few of his/her fingers between their foot and the strap, which is taut, making the task of inserting the user's fingers very difficult. Hence, once the fin is worn on the user's foot, if it appears to be too tight, the strap must be opened and the adjustment operation repeated.

OBJECTS AND SUMMARY OF THE INVENTION

Accordingly, it is an object of the present invention to provide a swimming fin with a heel strap fastening buckle that avoids the necessity of loosening the strap to enable the user to put on the fin and then adjust the strap tension.

Another object of the present invention is to provide a swimming fin with a heel strap fastening buckle that allows the user's foot to be removed from the shoe portion of the fin, without the user having to push the loosened strap under the heel.

A further object of the present invention is to provide a swimming fin with a heel strap fastening buckle that avoids the risk of accidental opening of the buckle, such as upon impact, in that opening the buckle and disengaging it from the fin requires that the user actuate at least one fastening device, which thereby acts as a safety actuator.

Still another object of the present invention is to provide a swimming fin with a heel strap fastening buckle that allows the strap to be loosened without opening the buckle by partially rotating a buckle element connected to the strap.

According to one aspect of the present invention, there is provided a swimming fin having a blade extending from a shoe open at its rear side and a rear heel strap connected to the sides of the shoe by at least one buckle. The buckle comprises a base plate integral with the shoe, a buckle arm joined with the strap so as to allow adjustment of the strap's tension, and an intermediate lever connected pivotally to the base plate and the arm. The buckle also includes a reversible attachment member for connecting, e.g., hooking, the intermediate lever to the base plate to achieve closure of the buckle, and a disengageable articulation member, between the intermediate lever and the base plate, for achieving reciprocal engagement between them, a pivotal connection and, at the same time, allowing their separation in a direction opposite to that of tensioning of the strap, such that the intermediate lever is separable from the base plate following release of the reversible attachment member and disconnection of the disengageable articulation member.

In accordance with another aspect of the present invention, a swimming fin is provided having a blade extending from a shoe open at its rear side and a rear heel strap connected to the sides of the shoe by at least one buckle. The buckle includes a base plate integral with the shoe, a buckle arm joined with the strap so as to allow adjustment of the strap's tension, an intermediate lever connected pivotally to the base plate and the arm, and a reversible attachment member for connecting the intermediate lever to the base plate to achieve closure of the buckle. The buckle also has a disengageable articulation member, between the intermediate lever and the base plate, for achieving reciprocal engagement between them, a pivotal connection and, at the same time, allowing their separation in a direction opposite to that of tensioning of the strap, such that the intermediate lever is separable from the base plate following release of the reversible attachment member and disconnection of the disengageable articulation member. The disengageable articulation member preferably comprises at least one cavity with an at least partially circular internal profile, formed on at least one shoulder rising from the base plate. The cavity is desirably closed on the side turned towards the arm connected to the strap and open on the opposite side. It is preferred that there be at least one projection of the intermediate lever for engaging the cavity, the projection having a complementary shape for allowing reciprocal rotation. Optionally, a plurality of opposing housings rise from the base plate with which corresponding end portions of the lever pivotally engage, the housings being open on one of their sides, so that the end portions can be withdrawn from the housings to separate the lever from the base plate.

According to a further aspect of the present invention is a swimming fin having a blade extending from a shoe open at its rear side and a rear heel strap connected to the sides of the shoe by at least one buckle. The buckle comprises a base plate integral with the shoe, a buckle arm joined with the strap so as to allow adjustment of the strap's tension, and an intermediate lever connected pivotally to the base plate and the arm. The buckle additionally has a reversible attachment member for connecting the intermediate lever to the base plate to achieve closure of the buckle, and a disengageable articulation member, between the intermediate lever and the base plate, for achieving reciprocal engagement between them, a pivotal connection and, at the same time, allowing their separation in a direction opposite to that of tensioning of the strap, such that the intermediate lever is separable from the base plate following release of the reversible attachment member and disconnection of the disengageable articulation member. Optionally, the attachment member has at least one first connection element on the intermediate lever, which can be snap engaged, to close the buckle, with at least one second complementary connection element formed in the thickness of the base plate. The at least one first connection element, formed on the lever, is provided with at least one push-button that can be actuated by the user to open the buckle. Alternatively or concurrently, the member for reversibly attaching the lever to the base plate comprises a plurality of hook arms projecting from one of its faces and elastically urged one against the other, at least one window and at least two opposing teeth, projecting internally from an edge of the window, correspondingly formed on the base plate, and the hook arms snap engaging the opposing teeth.

In accordance with still another aspect of the present invention, a swimming fin is provided having a blade extending from a shoe open at its rear side and with a rear heel strap connected to the sides of the shoe by at least one buckle. The buckle includes a base plate integral with the shoe, a buckle arm joined with connected to the strap so as to allow adjustment of the strap's tension, and an intermediate lever connected pivotally to the base plate and the arm. A reversible attachment member is provided for connecting the intermediate lever to the base plate to achieve closure of the buckle. A disengageable articulation member is also provided, between the intermediate lever and the base plate, for achieving reciprocal engagement between them, a pivotal connection and, at the same time, allowing their separation in a direction opposite to that of tensioning of the strap, so that the intermediate lever is separable from the base plate following release of the reversible attachment member and disconnection of the disengageable articulation member. Optionally, the reversible attachment member comprises a plurality of hook arms projecting from one of its faces and elastically urged one against the other, at least one window and at least two opposing teeth, projecting internally from an edge of the window, correspondingly formed on the base plate. Desirably, the hook arms snap engage with the opposing teeth and extend from respective push-buttons. An elastic member is provided between the respective push-buttons for maintaining them in a generally sideways projecting position relative to the lever. At such a position, the hook arms are engaged with the teeth, the push-buttons sliding one towards the other generally transverse to the lever, so that when the push-buttons are pressed by fingers of one hand of the user to overcome resistance of the elastic member placed between them, the hook arms are moveable away from the teeth so as to release the buckle.

BRIEF DESCRIPTION OF THE DRAWINGS

A specific, illustrative swimming fin, according to the present invention, is described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
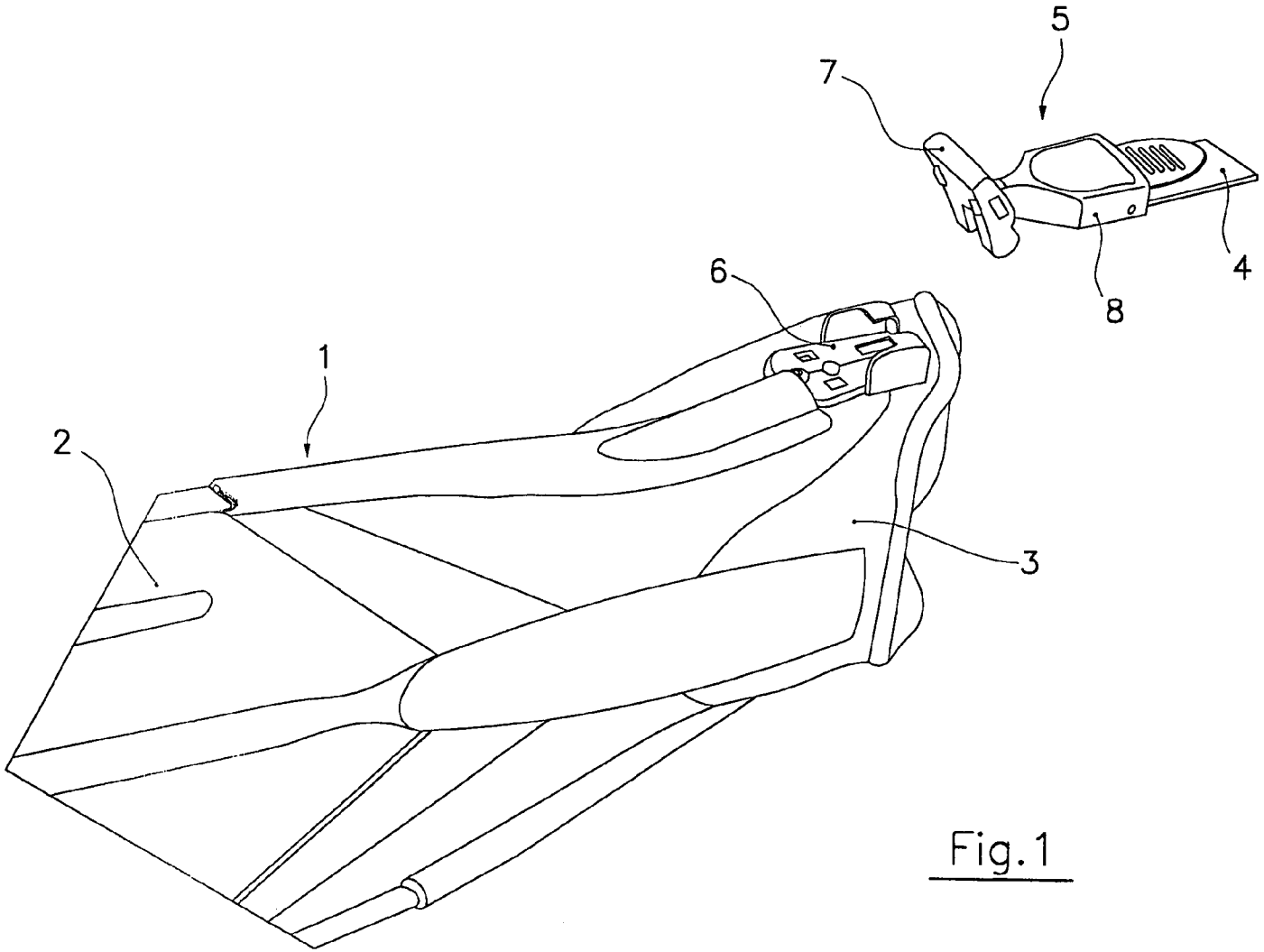
FIG. 1 is a partial perspective view of a swimming fin, according to one aspect of the present invention.

Referring now to the drawings and, more particularly, to FIGS. 1-13, there is shown generally a specific, illustrative swimming fin 1, according to various aspects of the present invention. In one embodiment, illustrated in FIG. 1, the swimming fin comprises a blade 2 extending from a shoe 3 of a type that is open at the rear end, and a heel strap 4 for securing the fin to a user's foot. Ends of the strap are preferably connected to respective buckles 5 attached externally to, e.g., sides of, the shoe.

Figure 2:
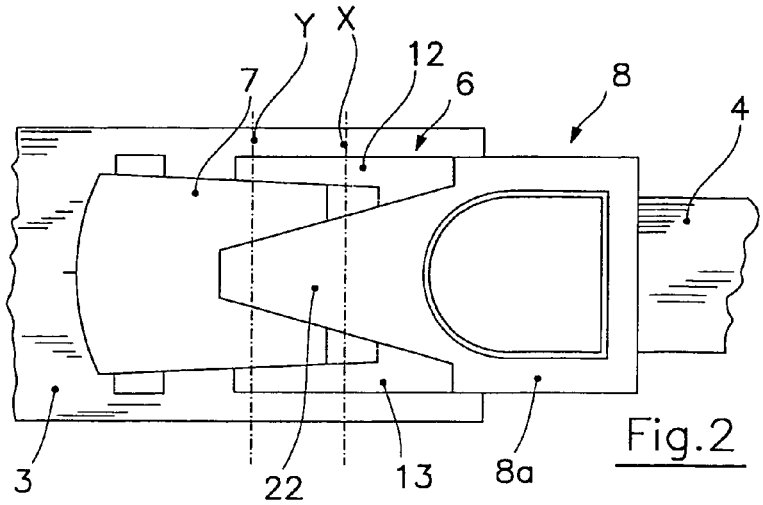
FIG. 2 is a plan view of the buckle set forth in FIG. 1, in a closed position.
Figure 3:
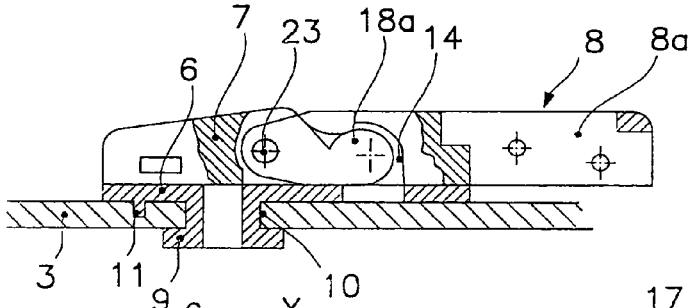
FIG. 3 is a partial sectional view, taken longitudinally, of the buckle shown in FIG. 2.

As shown in FIGS. 2 and 3, buckle 5 comprises a base plate 6 integral with one side of the shoe, and an intermediate lever 7 that may be joined reversibly to the base plate at its front end and articulated to the same at its rear end. The buckle also includes a buckle arm 8 hinged by its front end at an intermediate point of the lever and joined to strap 4 which extends from its opposite end. The hinging axes of the lever relative to the base plate and of arm 8 to the lever are generally parallel, such axes being denoted by X and Y, respectively, in FIG. 2. Generally speaking, the terms "front" and "rear", as set forth herein, refer desirably to the position of the fin relative to the foot of the user.

Base plate 6 is preferably attached to a side of the shoe by a pin 9 with a butterfly-shaped flange that can be engaged, and rotated through 90° relative to its operative position, in a seat 10 shaped correspondingly so as to allow its anchorage to the base plate and disengagement therefrom upon rotation through 90°. A further stop pin 11, which may be locked using a special tool, prevents rotation of the base plate from its operative position. Stop pin 11 and pin 9 preferably extend from the same face of the base plate, stop pin 11 engaging a corresponding seat formed on the side of the shoe.

Figure 4:
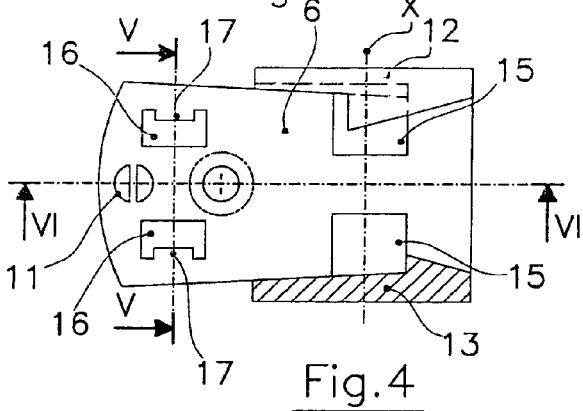
FIG. 4 is a sectional view taken along line IV-IV of FIG. 5 showing a buckle base plate integral with the fin.
Figure 5:
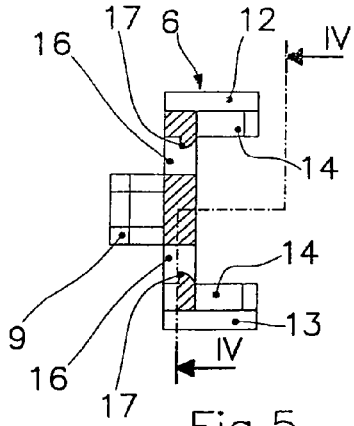
FIG. 5 is a sectional view of the buckle base plate taken along line V-V of FIG. 4.
Figure 6:
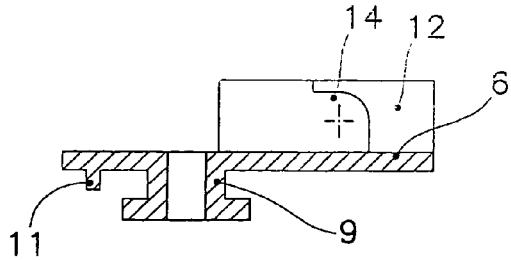
FIG. 6 is a sectional view of the buckle base plate taken along line VI-VI of FIG. 4.

As best seen in FIGS. 4, 5 and 6, opposing side shoulders 12 and 13 rise up from the opposite face of base plate 6. Each shoulder defines, on its internal side, a housing 14 turned towards the other shoulder with a profile that is at least partially circular, closed at its rear side, i.e., towards arm 8, and open at its front side. At each housing, windows 15 are formed on the base plate to facilitate engagement and disengagement of the intermediate lever. Two additional windows 16 are desirably formed on the base plate into which respective opposing teeth 17 project.

Figure 7:
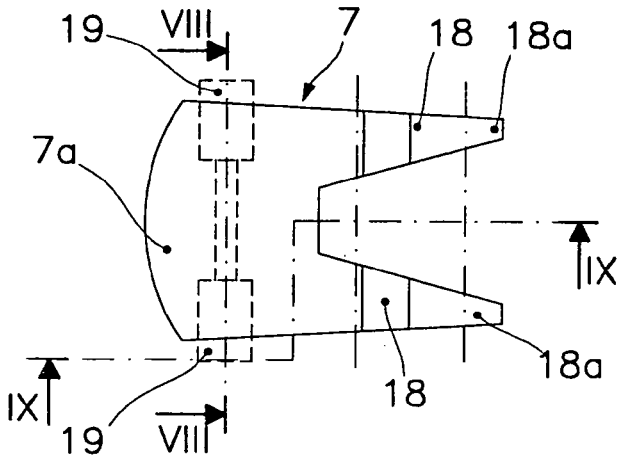
FIG. 7 is a plan view of an intermediate lever of a buckle mounted to a swimming fin, according to one aspect of the present invention.
Figure 8:
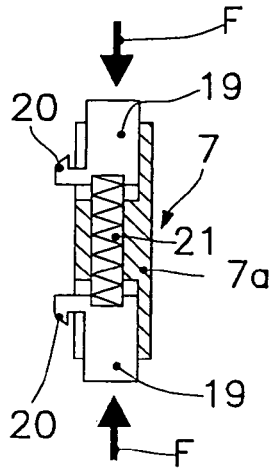
FIG. 8 is a sectional view of the intermediate lever taken along line VIII-VIII of FIG. 7.
Figure 9:
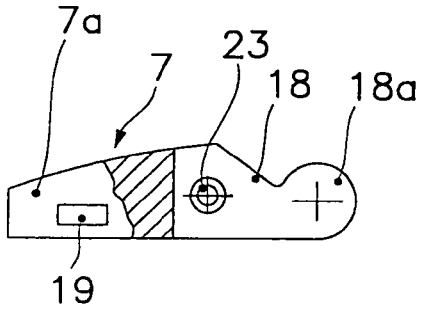
FIG. 9 is a sectional view of the intermediate lever taken along line IX-IX of FIG. 7.

Turning now to FIGS. 7, 8 and 9, lever 7 is preferably formed by a front body 7*a*. Two arms 18 extend rearwardly from sides of the front body, the arms each having an expansion 18*a* with a circular shape at its end. The circular expansions engage housings 14, as shown in FIG. 3, allowing rotation of the lever relative to base plate 6, in a manner illustrated generally in FIG. 12. Because the housings are open on their front side, the circular expansions engage freely with the housings. such that the lever may be separated from the base plate.

Near the opposite end of the lever, relative to the circular expansions, a hand operated lock member is provided, the lock member comprising a pair of push-buttons 19 projecting laterally from opposing sides of the lever body and sliding transversely relative thereto. According to one embodiment, the lock member also includes hook arms 20 extending from the push-buttons, respectively, toward the base plate for engagement with teeth 17, described above, which project into windows 16 of the base plate. An arrangement of this general description is illustrated in FIGS. 4 and 5. As shown in FIG. 8, a spring 21 is positioned between the push-buttons and extends generally transversely into a seat of lever body 7*a* so as to maintain them in an externally projecting position. In this manner, when the hook arms are engaged with the teeth, the lever is joined securely to the base plate. By pressing the push-buttons simultaneously, such as using two fingers of one hand, in the direction shown by arrows F in FIG. 8 to push them toward one another, the elastic resistance of spring 21 is overcome and hook arms 20 are caused to disengage from teeth 17, thereby releasing intermediate lever 7 from base plate 6. The intermediate lever can then attain the position shown in FIG. 12. In a subsequent position, shown in FIG. 13, the buckle is completely open and disengaged from the fin.

Figure 10:
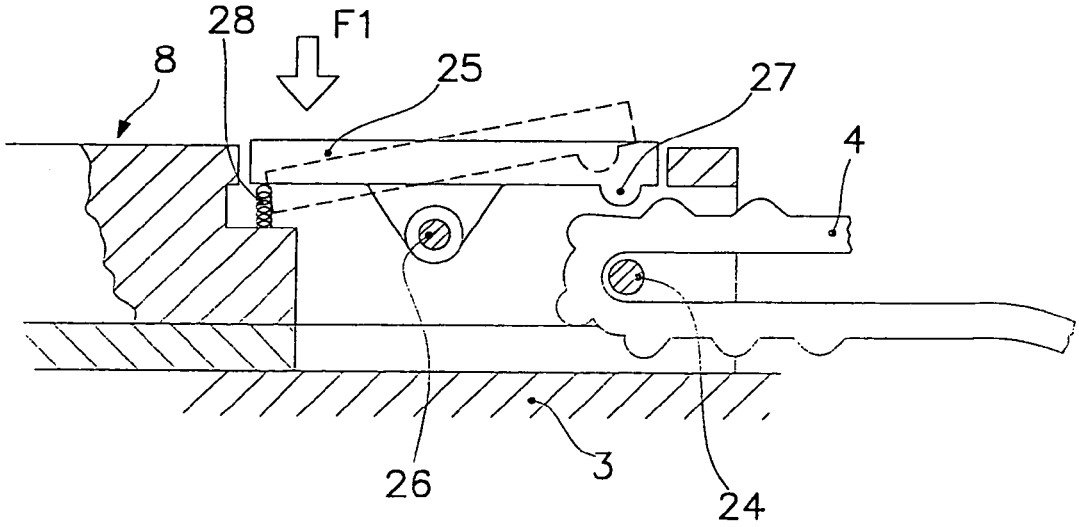
FIG. 10 shows a partial, enlarged, longitudinal cross section of a buckle arm integral with the strap, according to one aspect of the present invention.
Figure 11:
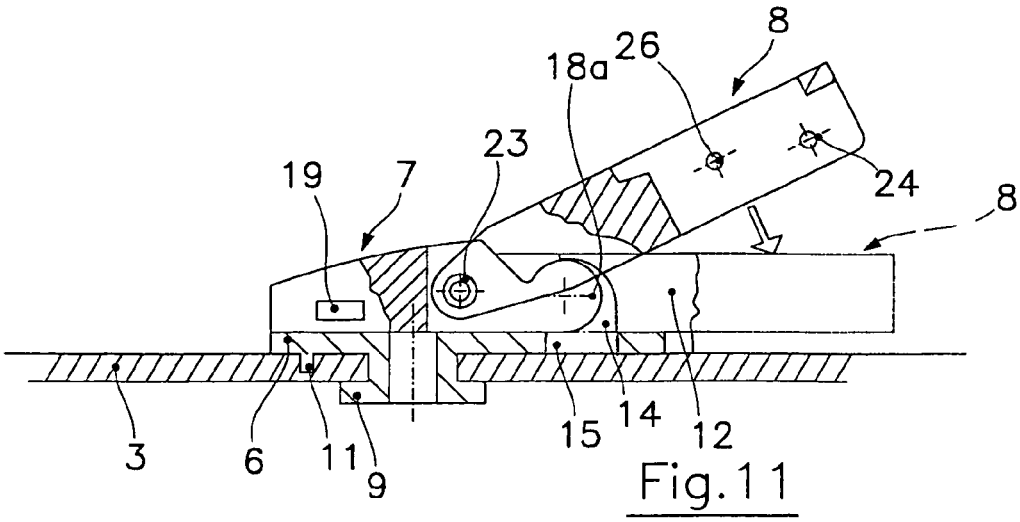
FIG. 11 shows a longitudinal and partial sectional view of the buckle, according to one aspect of the present invention, in a position in which, when the buckle is closed, the buckle arm joined to the strap may be loosened by its partial rotation, a dotted line indicating the arm in a closed, normal working position.

As best seen in FIGS. 2, 3 and 10, arm 8 for connection to strap 4 is formed at its rear side by a substantially box-shaped portion 8*a*, in which one end of the strap engages, and by a wing 22 extending from its opposite end between arms 18 of lever 7, the arm being articulated to the lever through a pin 23. The strap 4 is preferably engaged, as is typically the case, with box-shaped portion 8*a* of arm 8, in general, and wound on a transverse pin 24 placed therein, in particular. The box-shaped portion further comprises a push-button 25 hinged to a second transverse pin 26, also placed in the box-shaped portion. A tooth 27 extends from an internal face of the push-button for engagement between ribs of strap 4, thereby allowing the push-button to lock in the required position, while a spring 28 positioned on the diametrically opposite side, between the push-button and the box-shaped portion, forces the tooth against the strap and, thereby, prevents the strap from sliding. The tension of the strap may be adjusted by pressing the push-button in the direction of arrow F1 so as to overcome the elastic resistance of spring 28 and disengage tooth 27 from the transverse ribs of the strap, which can therefore slide freely around transverse pin 24 to either loosen or tighten the strap. Notably, in the position of arm 8, as shown in FIG. 11, the buckle is integral with the fin; it thus being possible to loosen the strap.

Figure 12:
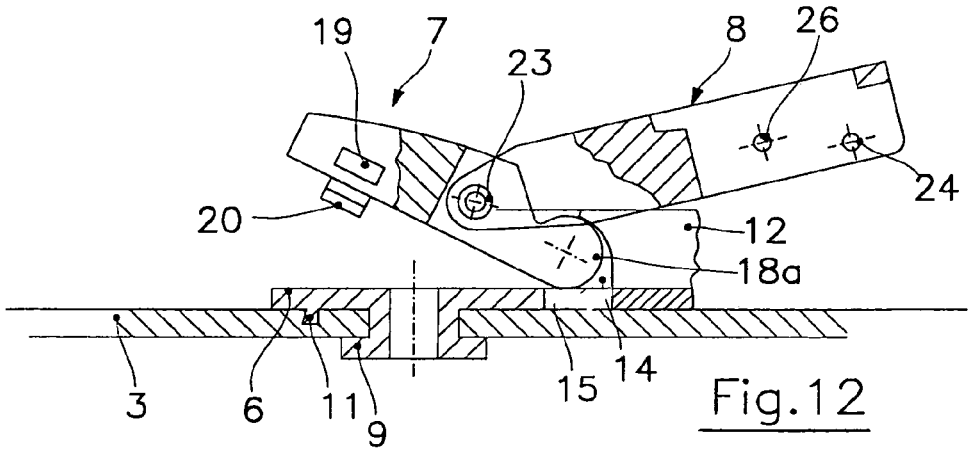
FIG. 12 shows a partial, longitudinal sectional view of the buckle shown in FIG. 11 in a first phase of opening.
Figure 13:
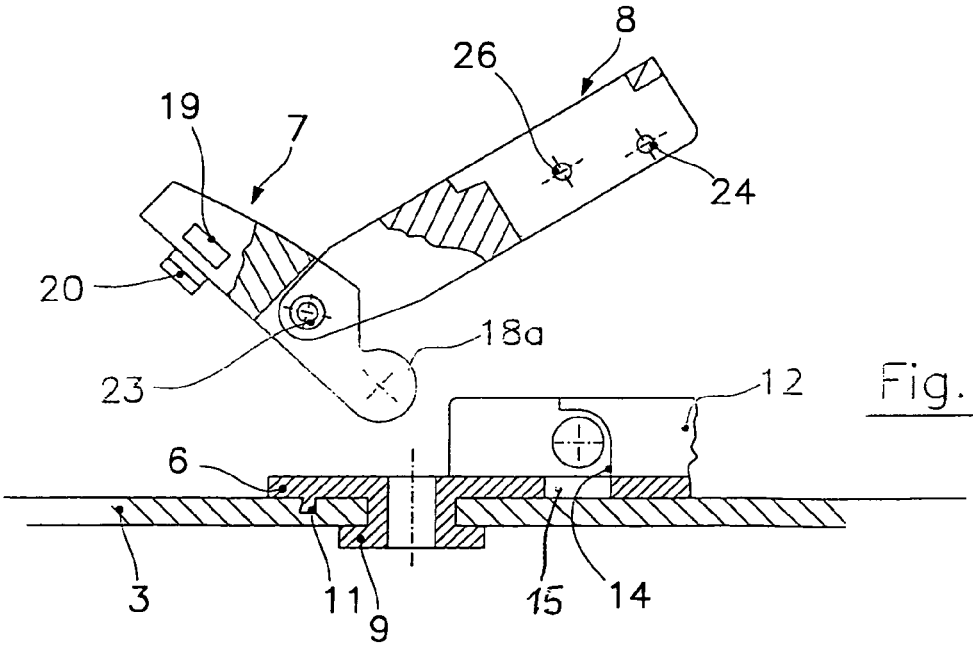
FIG. 13 shows a second phase of opening the buckle set forth in FIG. 11 with an intermediate lever, and having the buckle arm integral with the strap released from the base plate and integral with the shoe, according to another aspect of the present invention.

Operation of the buckle mounted to the fin in particular, when the buckle is to be opened without modifying the tension of the strap, is best seen in FIGS. 3, 12 and 13. To change from the condition shown in FIG. 3, i.e., where the buckle is closed and lever 7 is connected to base plate 6, to that shown in FIG. 12, where the lever has been released from the base plate by disengaging hook arms 20 from respective teeth 17 of the base plate, it is generally necessary that the user press push-buttons 19 such as using two fingers of the same hand. As shown in FIG. 12, intermediate lever 7 is released at its front end from the base plate, but is still articulated to the latter at its rear end; by disengaging circular expansions 18*a* of arms 18 of the lever from housings 14 of the base plate, the buckle is opened completely, as set forth in FIG. 13. While articulation between the base plate and the lever, through the circular expansions engaged in the housings, is a connection that is relatively unrestrained, restraint is generally ensured by the tension of the strap which, under the conditions shown in FIG. 3, prevents their disengagement from the housing, except in the event of accidental impact which could move intermediate lever 7 into the position illustrated in FIG. 12. According to various aspects of the present invention, this risk is avoided by use of a reversible attachment device or member formed collectively by elements 17, 19, 20 and 21, which may only be opened intentionally by the user.

Various modifications and alterations may be appreciated based on a review of this disclosure. These changes and additions are intended to be within the scope and spirit of the invention as defined by the following claims. For example, the reversible attachment member, formed by elements 17, 19, 20 and 21 that can be actuated using two fingers of the same hand via opposing push-buttons 19 and thereby act as a safety device may be replaced by a single push-button located transversely, or in a front central parts, of lever 7 and, in any case, preferably in a position where it is protected from accidental impact.

What is claimed is:

1. A swimming fin having a blade extending from a shoe open at its rear side and a rear heel strap connected to the sides of the shoe by at least one buckle, the buckle comprising a base plate integral with the shoe, a buckle arm joined with connected to the strap so as to allow adjustment of the strap's tension, an intermediate lever connected pivotally to the base plate and the arm, a reversible attachment member for connecting the lever to the base plate to achieve closure of the buckle, and a disengageable articulation member, between the intermediate lever and the base plate, for achieving reciprocal engagement between them, a pivotal connection and, at the same time, allowing their separation in a direction opposite that of tensioning of the strap, whereby the lever is separable from the base plate following release of the reversible attachment member and disconnection of the articulation member, wherein the articulation member comprises at least one cavity with an at least partly circular internal profile, formed on at least one shoulder rising from the base plate, the cavity being closed on the side turned toward the arm connected to the strap and open on the opposite side, and at least one projection of the lever for engaging the cavity, the projection having a complementary shape for allowing reciprocal rotation.

2. The swimming fin set forth in claim 1, wherein a plurality of opposing housings rise from the base plate with which corresponding end portions of the lever pivotally engage, the housings being open on one of their sides, whereby the end portions can be withdrawn from the housings to separate the lever from the base plate.

3. The swimming fin set forth in claim 2, wherein the lever is formed by a lever body with two arms extending therefrom, the ends of the arms pivotally engaging the housings, and the lever being pivotally connected at an intermediate position to one end of the arm for connection to the strap.

4. The swimming fin set forth in claim 3, wherein the push-buttons are located near an end of the lever opposite the arms.

5. The swimming fin set forth in claim 2, wherein at the opposite housings a plurality of windows are formed on the base plate.

6. The swimming fin set forth in claim 1, wherein the base plate is connected to the shoe by a butterfly-shaped flanged pin engaged with a complementary seat formed on one side of the shoe, the orientation of a complementary housing being rotated through 90° relative to a working position of the pin.

7. The swimming fin set forth in claim 1, wherein the arm for connection to the strap comprises a box-shaped body with an internal transverse pin on which the strap is wound, having a push-button hinged to the box-shaped body, and having an end resting on an elastic support, a diametrically opposed end of the push-button being shaped in such a way as to engage between a plurality of consecutive transverse surface ribs of the strap to prevent sliding thereof.

8. A swimming fin having a blade extending from a shoe open at its rear side and a rear heel strap connected to the sides of the shoe by at least one buckle, the buckle comprising a base plate integral with the shoe, a buckle arm joined with connected to the strap so as to allow adjustment of the strap's tension, an intermediate lever connected pivotally to the base plate and the arm, a reversible attachment member for connecting the lever to the base plate to close the buckle, and a disengageable articulation member, between the lever and the base plate, for achieving reciprocal engagement between them, a pivotal connection and, at the same time, allowing their separation in a direction opposite to that of tensioning of the strap, whereby the lever is separable from the base plate following release of the attachment member and disconnection of the articulation member, wherein the member for reversible attachment of the lever to the base plate comprises at least one first connection element on the lever, which can be snap engaged, to close the buckle, with at least one second complementary connection element formed in the thickness of the base plate, the at least one first connection element formed on the lever being provided with at least one push-button which can be actuated by the user to open the buckle.

9. A swimming fin having a blade extending from a shoe open at its rear side and with a rear heel strap connected to the sides of the shoe by at least one buckle, the buckle comprising a base plate integral with the shoe, a buckle arm joined with connected to the strap so as to allow adjustment of the strap's tension, an intermediate lever connected pivotally to the base plate and the arm, a reversible attachment member for connecting the lever to the base plate close the buckle, and a disengageable articulation member, between the lever and the base plate, for achieving reciprocal engagement between them, a pivotal connection and, at the same time, allowing their separation in a direction opposite to that of tensioning of the strap, whereby the lever is separable from the base plate following release of the attachment member and disconnection of the articulation member, wherein the member for reversible attachment of the lever to the base plate comprises first connection elements on the lever that can be snap engaged, when closing the buckle, with second complementary closure elements formed in the thickness of the base plate, the first connection elements having push-buttons on laterally opposing sides of the lever, that can be actuated by the user to cause their disengagement, when opening the buckle, from the second connection elements.

10. A swimming fin having a blade extending from a shoe open at its rear side and a rear heel strap connected to the sides of the shoe by at least one buckle, the buckle comprising a base plate integral with the shoe, a buckle arm joined with the strap so as to allow adjustment of the strap's tension, an intermediate lever connected pivotally to the base plate and the arm, a reversible attachment member for connecting the lever to the base plate to close the buckle, and a disengageable articulation member, between the lever and the base plate, for achieving reciprocal engagement between them, a pivotal connection and, at the same time, allowing their separation in a direction opposite to that of tensioning of the strap, whereby the intermediate lever is separable from the base plate following release of the attachment member and disconnection of the articulation member, wherein the member for reversibly attaching the lever to the base plate comprises a plurality of hook arms projecting from one of its faces and elastically urged one against the other, at least one window and at least two opposing teeth, projecting internally from an edge of the window, correspondingly formed on the base plate, and the hook arms snap engaging the opposing teeth.

11. The swimming fin set forth in claim 10, wherein the hook arms extend from respective push-buttons and an elastic member is provided therebetween for maintaining them in a generally sideways projecting position relative to the lever, wherein at such position the hook arms are engaged with the teeth, the push-buttons sliding one towards the other generally transverse to the lever, whereby when the push-buttons are pressed by fingers of one hand of the user to overcome resistance of the elastic member placed between them, the hook arms are moveable away from the teeth so as to release the buckle.

* * * * *